US009771905B2

(12) United States Patent
Jacques et al.

(10) Patent No.: US 9,771,905 B2
(45) Date of Patent: Sep. 26, 2017

(54) ENGINE ASSEMBLY INCLUDING INTAKE MANIFOLD ASSEMBLY

(75) Inventors: Robert Lionel Jacques, Troy, MI (US); Alan Edgar Bowler, Oxford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1054 days.

(21) Appl. No.: 13/084,795

(22) Filed: Apr. 12, 2011

(65) Prior Publication Data

US 2012/0260879 A1 Oct. 18, 2012

(51) Int. Cl.

*F02M 35/00* (2006.01)
*F02M 35/116* (2006.01)
*F02M 35/10* (2006.01)

(52) U.S. Cl.

CPC .... *F02M 35/116* (2013.01); *F02M 35/10045* (2013.01); *F02M 35/10052* (2013.01)

(58) Field of Classification Search

CPC ..... F02M 35/116
USPC ..... 123/14.34–184.35
See application file for complete search history.

(56) References Cited

U.S. PATENT DOCUMENTS 2,199,276 A * 4/1940 Barkeij ..... 123/184.32
3,717,131 A * 2/1973 Chana et al. ..... 123/184.35
5,048,471 A * 9/1991 Takii et al. ..... 123/184.36
5,127,371 A * 7/1992 Ogawa et al. ..... 123/184.34
5,515,822 A * 5/1996 Kobayashi et al. ..... 123/184.35

OTHER PUBLICATIONS

Porsche 928 S4 Engine, circa 1986, 1 page.

* cited by examiner

*Primary Examiner* — Lindsay Low
*Assistant Examiner* — Kevin A Lathers
(74) *Attorney, Agent, or Firm* — Harness, Dickey & Pierce, P.L.C.

(57) ABSTRACT

An engine assembly includes an engine structure and an intake manifold assembly coupled to the engine structure. The engine structure defines first and second banks of cylinders. The intake manifold assembly includes first and second plenums and first and second sets of runners. The first and second plenums are located laterally between the first and second banks of cylinders. The second plenum is located laterally between the first plenum and the second bank of cylinders at first and second longitudinal ends of the intake manifold assembly and laterally between the first plenum and the first bank of cylinders at a medial region of the intake manifold assembly.

20 Claims, 5 Drawing Sheets

ENGINE ASSEMBLY INCLUDING INTAKE MANIFOLD ASSEMBLY

FIELD

The present disclosure relates to engine intake manifold arrangements.

BACKGROUND

This section provides background information related to the present disclosure which is not necessarily prior art.

Internal combustion engines may combust a mixture of air and fuel in cylinders and thereby produce drive torque. Combustion of the air-fuel mixture produces exhaust gases. Engines may include intake ports to direct air flow to the combustion chambers and exhaust ports to direct exhaust gases from the combustion chambers. An intake manifold may be used to direct air flow to the intake ports.

SUMMARY

An engine assembly may include an engine structure and an intake manifold assembly coupled to the engine structure. The engine structure may define a first bank of cylinders and a second bank of cylinders disposed at an angle relative to one another. The intake manifold assembly may include a first plenum, a second plenum, a first set of runners and a second set of runners. The first plenum and the second plenum may each be located laterally between the first and second banks of cylinders. The second plenum may be located laterally between the first plenum and the second bank of cylinders at first and second longitudinal ends of the intake manifold assembly and may be located laterally between the first plenum and the first bank of cylinders at a medial region of the intake manifold assembly longitudinally between the first and second longitudinal ends. The first set of runners may extend from the first plenum to the engine structure and the second set of runners may extend from the second plenum to the engine structure.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings.

The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
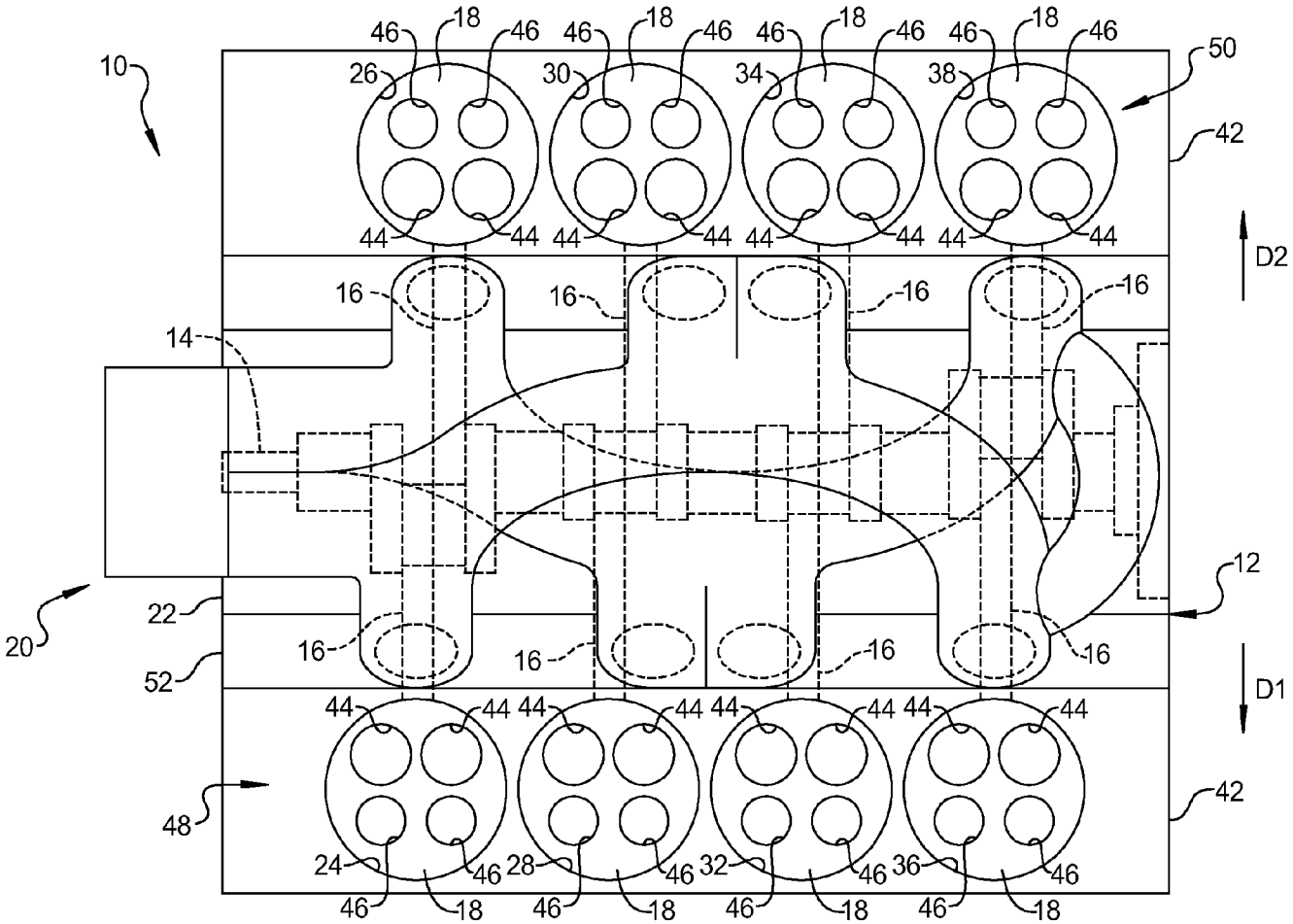
FIG. 1 is a schematic illustration of an engine assembly according to the present disclosure.

An engine assembly 10 is schematically illustrated in FIG. 1 and may include an engine structure 12, a crankshaft 14, connecting rods 16, pistons 18 and an intake manifold assembly 20. The engine structure 12 may include an engine block 22 defining cylinders 24, 26, 28, 30, 32, 34, 36, 38 and cylinder heads 42 coupled to the engine block 22 and defining intake ports 44 and exhaust ports 46. Pistons 18 may be located in the cylinders 24, 26, 28, 30, 32, 34, 36, 38 and coupled to the crankshaft 14 via connecting rods 16.

The engine structure 12 may form a V8 arrangement defining a first bank of cylinders 48 including four cylinders 24, 28, 32, 36 and a second bank of cylinders 50 including four cylinders 26, 30, 34, 38 disposed at an angle relative to one another. The first cylinder 24 and the second cylinder 26 may be located at a first longitudinal end 52 of the engine structure 12. The third cylinder 28 may be adjacent to the first cylinder 24 and the fourth cylinder 30 may be adjacent to the second cylinder 26. The fifth cylinder 32 may be adjacent to the third cylinder 28 and the sixth cylinder 34 may be adjacent to the fourth cylinder 30. The seventh cylinder 36 may be adjacent to the fifth cylinder 32 and the eighth cylinder 38 may be adjacent to the sixth cylinder 34.

Figure 5:
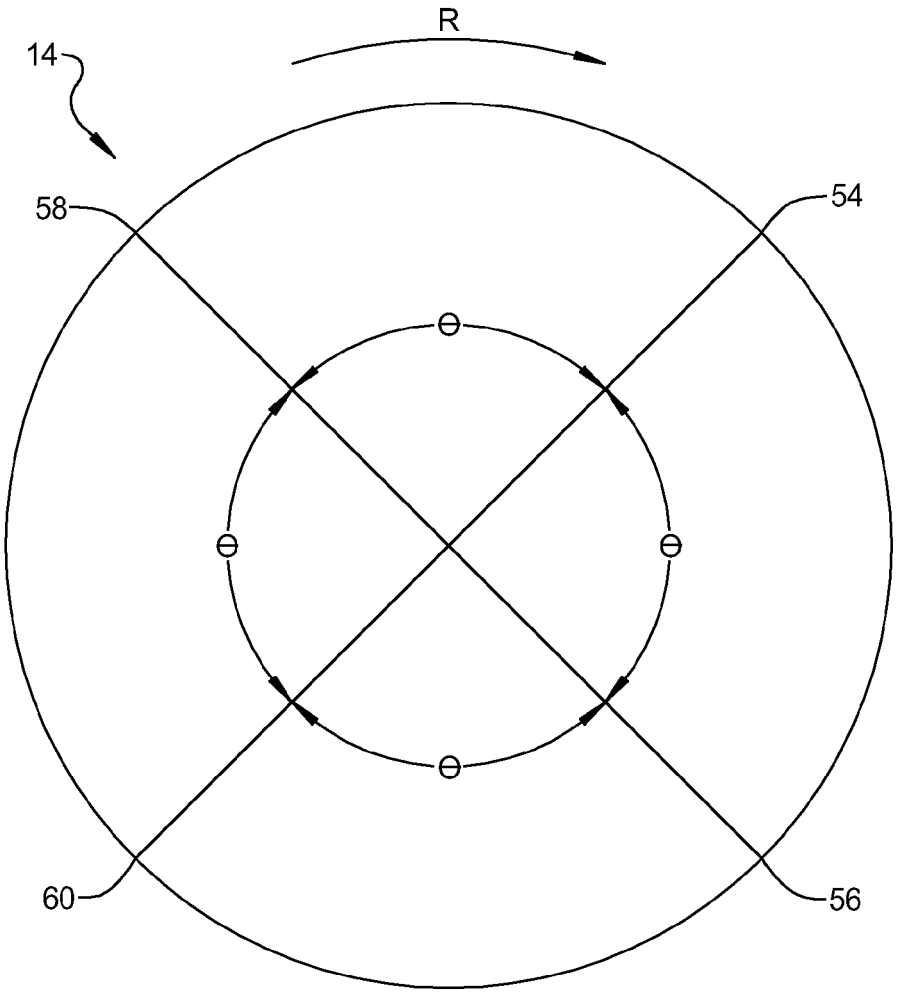
FIG. 5 is a schematic illustration of the crank pin orientation of the engine assembly of FIG. 1.

With additional reference to FIG. 5, the crankshaft 14 may include first, second, third and fourth crank pins 54, 56, 58, 60 rotationally offset from one another by an angle (θ). By way of non-limiting example, the angle (θ) may be ninety degrees to form a two-plane arrangement. The second crank pin 56 may be rotationally offset from the first crank pin 54 by ninety degrees in the rotational direction (R) of the crankshaft 14. The third crank pin 58 may be rotationally offset from the first crank pin 54 by two hundred and seventy degrees in the rotational direction (R) of the crankshaft 14. The fourth crank pin 60 may be rotationally offset from the first crank pin 54 by one hundred and eighty degrees in the rotational direction (R) of the crankshaft 14.

Figure 2:
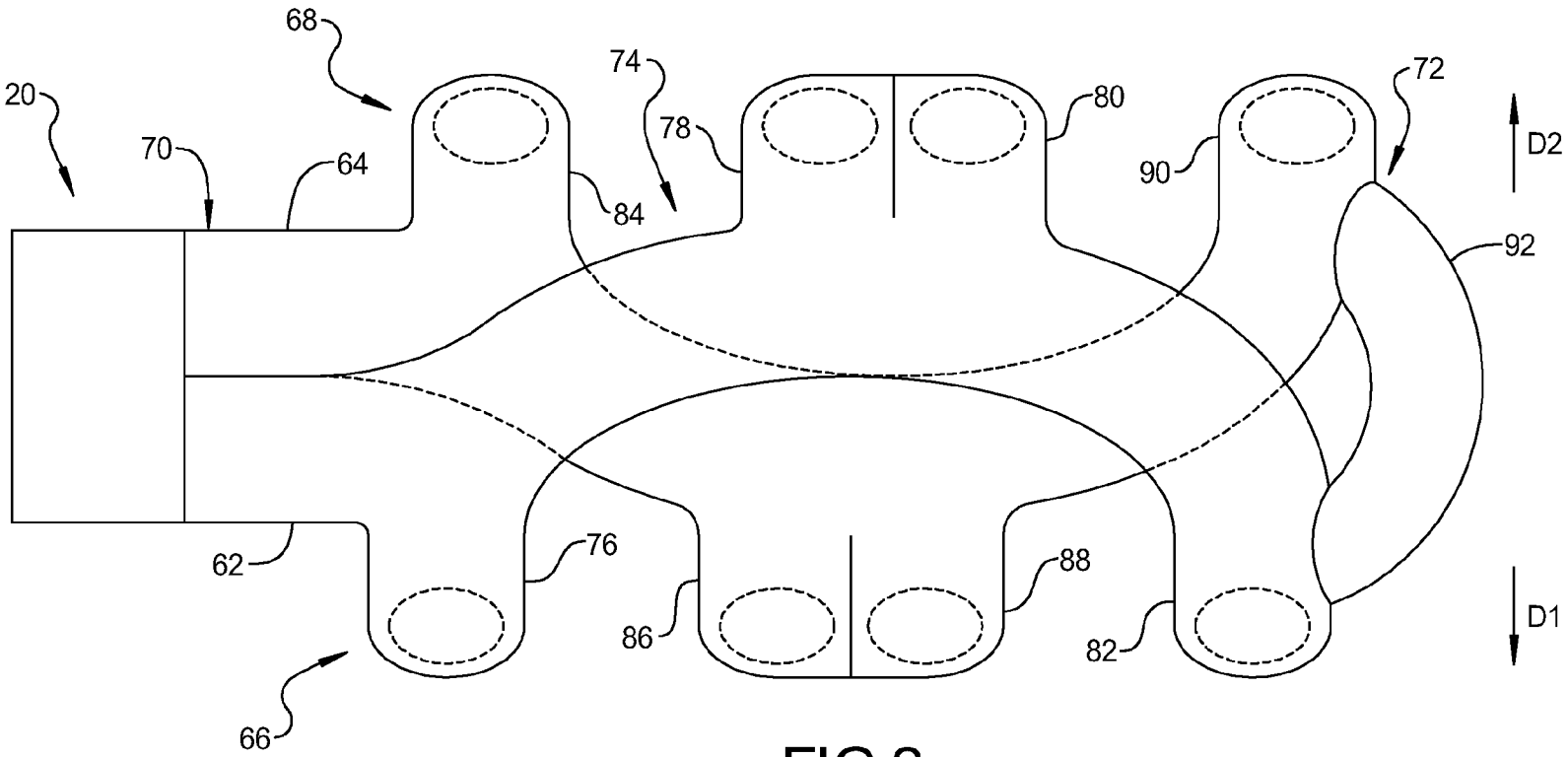
FIG. 2 is a schematic illustration of the intake manifold assembly shown in FIG. 1.

As seen in FIGS. 1 and 2, the intake manifold assembly 20 may be coupled to the engine structure 12 and may include a first plenum 62, a second plenum 64, a first set of runners 66 extending from the first plenum 62 and a second set of runners 68 extending from the second plenum 64. The second plenum 64 may be coupled to the first plenum 62. The first plenum 62 and the second plenum 64 may each be located laterally between the first and second banks of cylinders 48, 50 and may overlap one another.

The second plenum 64 may be located on a first lateral side of the first plenum 62 and laterally between the first plenum 62 and the second bank of cylinders 50 at first and second longitudinal ends 70, 72 of the intake manifold assembly 20. The second plenum 64 may be located on a second lateral side of the first plenum 62 opposite the first lateral side and laterally between the first plenum 62 and the first bank of cylinders 48 at a medial region 74 of the intake manifold assembly 20 longitudinally between the first and second longitudinal ends 70, 72. The first and second plenums 62, 64 may be in communication with one another at the second longitudinal end 72 of the intake manifold assembly 20. The connection 92 may include a passive conduit or a valve arrangement. Alternatively, the first and second plenums 62, 64 may be isolated from one another. Additional passive or valved communication passages between the first and second longitudinal ends, between medial sections or between longitudinal end and medial sections can be accomplished as required for chosen firing order of the engine and packaging constraints. Communication at the second longitudinal end 72 is depicted for illustrative purposes.

The first and second sets of runners 66, 68 may extend to the engine structure 12 and provide communication between the cylinders 24, 26, 28, 30, 32, 34, 36, 38 and the intake manifold assembly 20. In the present non-limiting example, the first set of runners 66 includes first, second, third and fourth runners 76, 78, 80, 82 and the second set of runners 68 includes fifth, sixth, seventh and eighth runners 84, 86, 88, 90. The first runner 76 and the fifth runner 84 may each be located at the first longitudinal end 70 of the intake manifold assembly 20 and the fourth runner 82 and the eighth runner 90 may each be located at the second longitudinal end 72 of the intake manifold assembly 20. The second and third runners 78, 80 may be located longitudinally between the first and fourth runners 76, 82 and the sixth and seventh runners 86, 88 may be located longitudinally between the fifth and eighth runners 84, 90.

The first set of runners 66 may include two runners extending in a first lateral direction (D1) in communication with the first bank of cylinders 48 and two runners extending in a second lateral direction (D2) opposite the first lateral direction (D1) and in communication with the second bank of cylinders 50. Similarly, the second set of runners 68 may include two runners extending in the first lateral direction (D1) and in communication with the first bank of cylinders 48 and two runners extending in the second lateral direction (D2) and in communication with the second bank of cylinders 50. The first and fourth runners 76, 82 may extend from the first plenum 62 in the first lateral direction (D1) away from the second plenum 64 and the second and third runners 78, 80 may extend from the first plenum 62 in the second lateral direction (D2) away from the second plenum 64. The fifth and eighth runners 84, 90 may extend from the second plenum 64 in the second lateral direction (D2) away from the first plenum 62 and the sixth and seventh runners 86, 88 may extend from the second plenum 64 in the first lateral direction (D1) away from the first plenum 62.

In the present non-limiting example, the first runner 76 is in communication with the first cylinder 24, the second runner 78 is in communication with the fourth cylinder 30, the third runner 80 is in communication with the sixth cylinder 34, the fourth runner 82 is in communication with the seventh cylinder 36, the fifth runner 84 is in communication with the second cylinder 26, the sixth runner 86 is in communication with the third cylinder 28, the seventh runner 88 is in communication with the fifth cylinder 32 and the eighth runner 90 is in communication with the eighth cylinder 38. The length of each of the first, second, third and fourth runners 76, 78, 80, 82 may be equal to one another and the length of each of the fifth, sixth, seventh and eighth runners 84, 86, 88, 90 may be equal to one another. More specifically, the first, second, third, fourth, fifth, sixth, seventh and eighth runners 76, 78, 80, 82, 84, 86, 88, 90 may be equal in length. The separate first and second plenums 62, 64 and common runner length may limit cylinder-to-cylinder air flow variation.

The engine assembly 10 may define a firing order alternating firing between a first group of cylinders including the first, fourth, sixth and seventh cylinders 24, 30, 34, 36 and a second group of cylinders including the second, third, fifth and eighth cylinders 26, 28, 32, 38. The firing order may include a cylinder being fired every ninety degrees of crankshaft rotation. In the present non-limiting example, the firing order includes firing the first cylinder 24, then the fifth cylinder 32, then the fourth cylinder 30, then the third cylinder 28, then the sixth cylinder 34, then the eighth cylinder 38, then the seventh cylinder 36, then the second cylinder 26. Therefore, adjacent cylinders in the firing order are not in communication with a common plenum.

Figure 3:
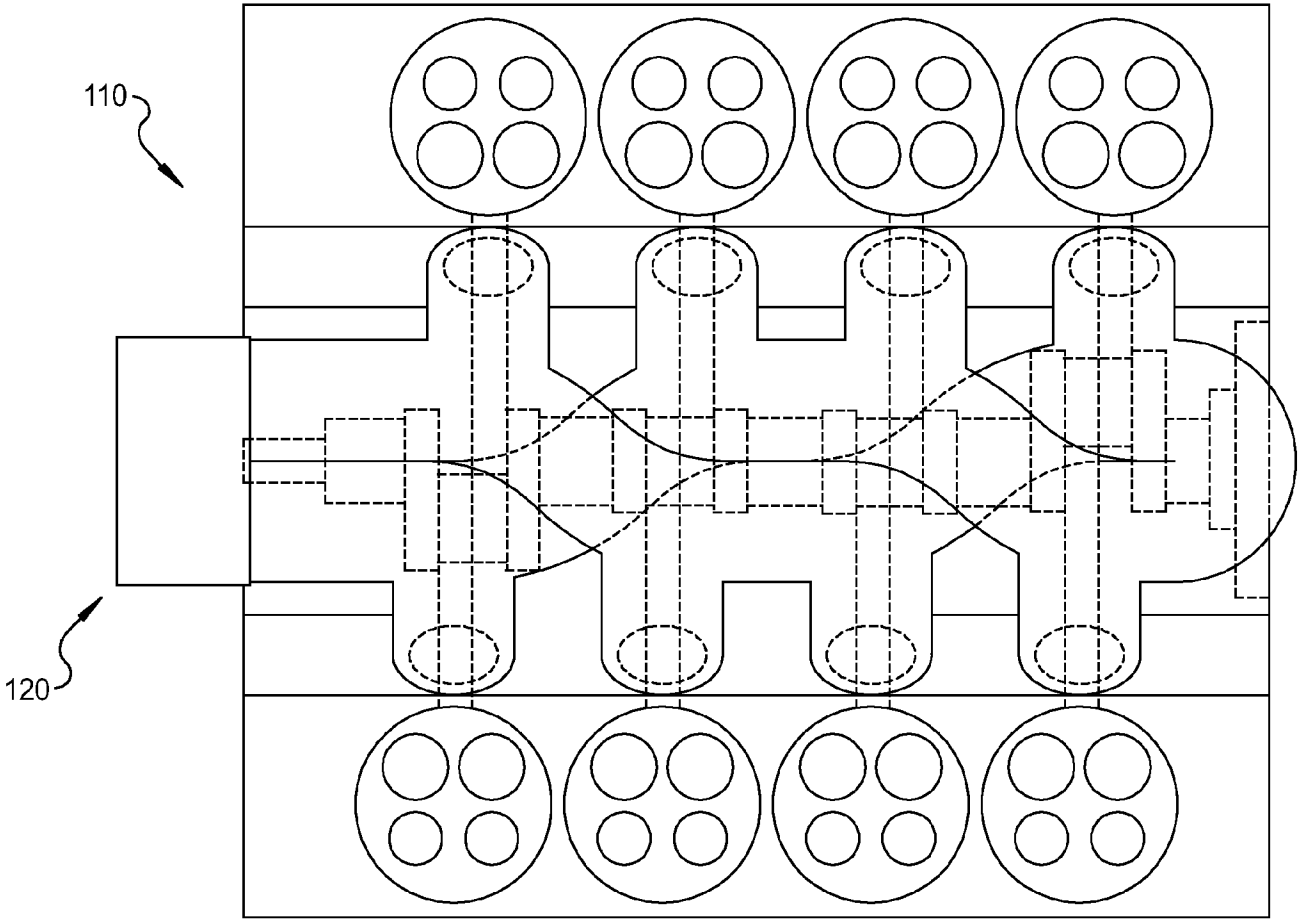
FIG. 3 is a schematic illustration of an alternate engine assembly according to the present disclosure.
Figure 4:
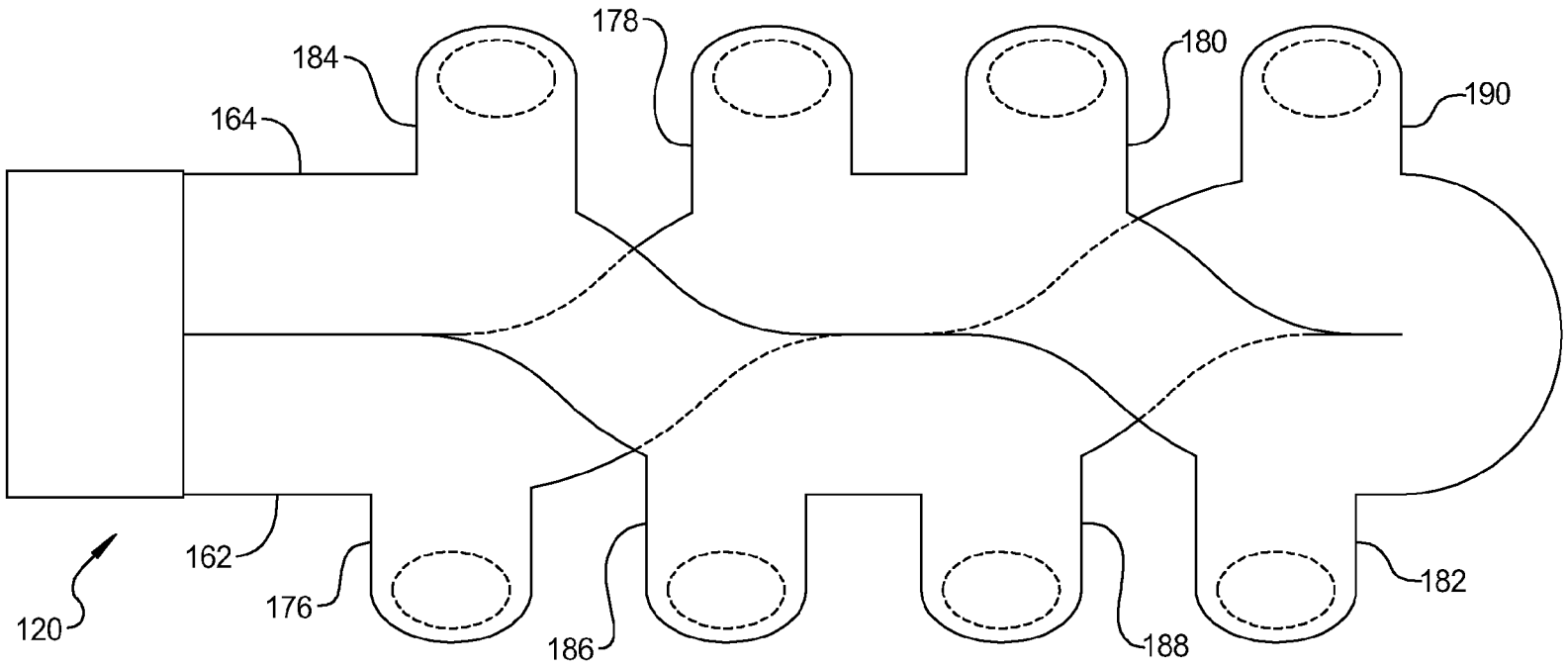
FIG. 4 is a schematic illustration of the intake manifold assembly shown in FIG. 3.

An alternate engine assembly 110 is shown in FIG. 3. The engine assembly 110 may be similar to the engine assembly 10 shown in FIG. 1 with the exception of the intake manifold assembly 120 seen in FIGS. 3 and 4. However, the intake manifold assembly 120 may include an intertwined spiral arrangement formed by the overlapping of the first and second plenums 162, 164. The remaining description regarding communication between the first and second plenums 62, 64 including the arrangement of the runners 76, 78, 80, 82, 84, 86, 88, 90 provided above applies equally to the first and second plenums 162, 164 and runners 176, 178, 180, 182, 184, 186, 188, 190 and will not be repeated for simplicity.

What is claimed is:

1. An intake manifold assembly comprising:

a first plenum having an inlet at a first end;

a second plenum having an inlet at a first end and adjacent to the first plenum and located on a first lateral side of the first plenum at first and second longitudinal ends of the intake manifold assembly and located on a second lateral side of the first plenum opposite the first lateral side at a medial region of the intake manifold assembly longitudinally between the first and second longitudinal ends, the first and the second plenums each including a second longitudinal end in communication with one another;

a first set of runners extending from the first plenum at a location between the first end and a second end of the first plenum; and a second set of runners extending from the second plenum at a location between the first end and a second end of the second plenum.

2. The intake manifold assembly of claim 1, wherein the first set of runners includes a first runner extending in a first lateral direction away from the second plenum and a second runner extending in a second lateral direction opposite the first lateral direction.

3. The intake manifold assembly of claim 1, wherein the first set of runners includes two runners extending in a first lateral direction and two runners extending in a second lateral direction opposite the first lateral direction and the second set of runners includes two runners extending in the first lateral direction and two runners extending in the second lateral direction.

4. The intake manifold assembly of claim 3, wherein the first set of runners includes a first runner at the first longitudinal end of the intake manifold assembly extending in the first lateral direction, second and third runners at the medial region of the intake manifold assembly extending in the second lateral direction and a fourth runner at the second longitudinal end of the intake manifold assembly extending in the first lateral direction.

5. The intake manifold assembly of claim 4, wherein the second set of runners includes a fifth runner at the first longitudinal end of the intake manifold assembly extending in the second lateral direction, sixth and seventh runners at the medial region of the intake manifold assembly extending in the first lateral direction and an eighth runner at the second longitudinal end of the intake manifold assembly extending in the second lateral direction.

6. The intake manifold assembly of claim 1, wherein the second plenum overlaps the first plenum.

7. The intake manifold assembly of claim 1, wherein the first plenum and the second plenum are intertwined forming a spiral arrangement along a longitudinal extent of the intake manifold assembly.

8. The intake manifold assembly of claim 1, wherein each runner in the first and second sets of runners are equal in length.

9. The intake manifold assembly of claim 1, wherein the second plenum is coupled to the first plenum.

10. An engine assembly comprising:

an engine structure defining a first bank of cylinders and a second bank of cylinders disposed at an angle relative to one another; and an intake manifold assembly coupled to the engine structure and including:

a first plenum having an inlet at a first end and located laterally between the first and second banks of cylinders;

a second plenum having an inlet at a first end and located laterally between the first and second banks of cylinders, the second plenum located laterally between the first plenum and the second bank of cylinders at first and second longitudinal ends of the intake manifold assembly and located laterally between the first plenum and the first bank of cylinders at a medial region of the intake manifold assembly longitudinally between the first and second longitudinal ends, the first and the second plenums each including a second longitudinal end in communication with one another;

a first set of runners extending from the first plenum at a location between the first end and a second end of the first plenum and extending to the engine structure; and a second set of runners extending from the second plenum at a location between the first end and a second end of the second plenum and extending to the engine structure.

11. The engine assembly of claim 10, wherein the first set of runners includes a first runner in communication with a cylinder located in the first bank of cylinders and a second runner in communication with a cylinder located in the second bank of cylinders.

12. The engine assembly of claim 10, wherein the first bank of cylinders includes four cylinders and the second bank of cylinders includes four cylinders, forming a V8 engine arrangement, the first set of runners includes two runners in communication with two cylinders from the first bank of cylinders and two runners in communication with two cylinders on the second bank of cylinders and the second set of runners includes two runners in communication with two cylinders from the first bank of cylinders and two runners in communication with two cylinders on the second bank of cylinders.

13. The engine assembly of claim 10, wherein the first bank of cylinders defines a first cylinder and the second bank of cylinders defines a second cylinder, the first bank of cylinders defines a third cylinder adjacent to the first cylinder and the second bank of cylinders defines a fourth cylinder adjacent to the second cylinder, the first bank of cylinders defines a fifth cylinder adjacent to the third cylinder and the second bank of cylinders defines a sixth cylinder adjacent to the second cylinder, and the first bank of cylinders defines a seventh cylinder adjacent to the fifth cylinder and the second bank of cylinders defines an eighth cylinder adjacent to the sixth cylinder, the first set of runners including a first runner in communication with the first cylinder, a second runner in communication with the fourth cylinder, a third runner in communication with the sixth cylinder and a fourth runner in communication with the seventh cylinder, and the second set of runners including a fifth runner in communication with the second cylinder, a sixth runner in communication with the third cylinder, a seventh runner in communication with the fifth cylinder and an eighth runner in communication with the eighth cylinder.

14. The engine assembly of claim 13, wherein a firing order of the engine assembly includes alternating firing between a first group of cylinders including the first, fourth, sixth and seventh cylinders and a second group of cylinders including the second, third fifth and eighth cylinders.

15. The engine assembly of claim 14, wherein the firing order includes firing the first cylinder, then the fifth cylinder, then the fourth cylinder, then the third cylinder, then the sixth cylinder, then the eighth cylinder, then the seventh cylinder, then the second cylinder.

16. The engine assembly of claim 14, wherein the firing order includes one of the cylinders from the first group or the second group being fired every ninety degrees of crankshaft rotation.

17. The engine assembly of claim 10, wherein the second plenum overlaps the first plenum.

18. The engine assembly of claim 10, wherein each runner in the first and second sets of runners are equal in length.

19. The engine assembly of claim 10, further comprising pistons located in cylinders defined by the first and second banks of cylinders and a crankshaft defining four crank pins disposed 90 degrees apart from one another and coupled to the pistons.

20. An engine assembly comprising:

an engine structure defining a first bank of cylinders and a second bank of cylinders disposed at an angle relative to one another; and an intake manifold assembly coupled to the engine structure and including:

a first plenum located laterally between the first and second banks of cylinders and including an inlet at a first end;

a second plenum located laterally between the first and second banks of cylinders and including an inlet at a first end, the second plenum located laterally between the first plenum and the second bank of cylinders at first and second longitudinal ends of the intake manifold assembly and located laterally between the first plenum and the first bank of cylinders at a medial region of the intake manifold assembly longitudinally between the first and second longitudinal ends, the first and the second plenums each including a second longitudinal end in communication with one another;

a first set of runners extending from the first plenum to the engine structure; and a second set of runners extending from the second plenum to the engine structure, wherein the first plenum and the second plenum are intertwined forming a spiral arrangement along a longitudinal extent of the intake manifold assembly.

* * * * *